US012162712B2

(12) United States Patent
Yamamoto

(10) Patent No.: US 12,162,712 B2
(45) Date of Patent: Dec. 10, 2024

(54) SHEET PROCESSING APPARATUS AND METHOD

(71) Applicant: TOSHIBA TEC KABUSHIKI KAISHA, Tokyo (JP)

(72) Inventor: Mikio Yamamoto, Izunokuni Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 18/471,339

(22) Filed: Sep. 21, 2023

(65) Prior Publication Data

US 2024/0199368 A1 Jun. 20, 2024

Related U.S. Application Data

(63) Continuation of application No. 18/080,776, filed on Dec. 14, 2022, now Pat. No. 11,795,028.

(51) Int. Cl.
*B65H 45/30* (2006.01)
*B65H 43/00* (2006.01)

(52) U.S. Cl.
CPC ..... *B65H 45/30* (2013.01); *B65H 43/00* (2013.01); *B65H 2511/13* (2013.01); *B65H 2511/30* (2013.01)

(58) Field of Classification Search
CPC ..... B31F 1/0006; B31F 1/0035; B65H 45/12; B65H 45/30; B65H 2301/51232; B65H 2701/13212
USPC ..... 270/32, 45
See application file for complete search history.

(56) References Cited

U.S. PATENT DOCUMENTS

| | | | | |
|---|---|---|---|---|
| 7,798,950 | B2 | 9/2010 | Kobayashi et al. | |
| 8,235,371 | B2 | 8/2012 | Taguchi et al. | |
| 8,613,435 | B2 * | 12/2013 | Kato | B65H 45/18 270/32 |
| 8,733,753 | B2 | 5/2014 | Soga et al. | |
| 9,050,772 | B2 | 6/2015 | Hidaka et al. | |
| 9,221,648 | B2 | 12/2015 | Sugiyama et al. | |
| 9,815,656 | B2 | 11/2017 | Awano | |

(Continued)

FOREIGN PATENT DOCUMENTS

JP 2012-153532 8/2012

*Primary Examiner* — Leslie A Nicholson, III
(74) *Attorney, Agent, or Firm* — Amin, Turocy & Watson, LLP

(57) ABSTRACT

A sheet processing apparatus includes a folding unit, a fold reinforcing unit, and a control unit. The folding unit folds a sheet and forms a fold line thereon. The fold reinforcing unit includes a fold reinforcing roller. The fold reinforcing roller sandwiches the fold line on the sheet formed by the folding unit and moves in a fold-line direction in which the fold line extends. The control unit moves the fold reinforcing roller from a first position close to a first end of the fold line on a first side in the fold-line direction to a second position close to a second end of the fold line on a second side opposite to the first side. The control unit can execute, at this time, a division movement mode including a reversal return operation. The reversal return operation is an operation of reversing a movement direction of the fold reinforcing roller to the first side at a middle portion of the fold line and then returning the movement direction of the fold reinforcing roller to the second side.

18 Claims, 10 Drawing Sheets

(56) References Cited

U.S. PATENT DOCUMENTS

| | | | |
|---|---|---|---|
| 9,919,893 | B2 | 3/2018 | Fukasawa et al. |
| 10,625,971 | B2 | 4/2020 | Horiguchi |
| 2010/0194018 | A1 | 8/2010 | Taguchi |
| 2012/0190526 | A1 | 7/2012 | Terao |

* cited by examiner

SHEET PROCESSING APPARATUS AND METHOD

CROSS-REFERENCE TO RELATED APPLICATION

This application is a Continuation of application Ser. No. 18/080,776 filed on Dec. 14, 2022, the entire contents of which are incorporated herein by reference.

FIELD

Embodiments described herein relate generally to a sheet processing apparatus and a sheet processing method.

BACKGROUND

A sheet processing apparatus includes a folding unit configured to fold a sheet to form a fold line on the sheet and a fold reinforcing unit configured to reinforce the fold line on the sheet. The sheet processing apparatus capable of enhancing fold reinforcement is required.

DETAILED DESCRIPTION

In general, according to one embodiment, a sheet processing apparatus includes a folding unit, a fold reinforcing unit, and a control unit. The folding unit folds a sheet and forms a fold line thereon. The fold reinforcing unit includes a fold reinforcing roller. The fold reinforcing roller sandwiches the fold line on the sheet formed by the folding unit and moves in a fold-line direction in which the fold line extends. The control unit moves the fold reinforcing roller from a first position close to a first end of the fold line on a first side in the fold-line direction to a second position close to a second end of the fold line on a second side opposite to the first side. The control unit can execute, at this time, a division movement mode including a reversal return operation. The reversal return operation is an operation of reversing a movement direction of the fold reinforcing roller to the first side at a middle portion of the fold line and then returning the movement direction of the fold reinforcing roller to the second side.

Hereinafter, a post-processing apparatus according to an embodiment will be described with reference to the drawings.

As an overall coordinate system of the present application, XYZ directions of an orthogonal coordinate system are defined as follows. The Z direction is a vertical direction, and the X and Y directions are horizontal directions. The Z direction is an upward-and-downward direction (height direction) of an image forming apparatus, and the +Z direction is an upward direction. The X direction is a forward-and-rearward direction (depth direction) of the image forming apparatus, and the +X direction is a forward direction. The Y direction is a left-and-right direction (width direction) of the image forming apparatus.

Figure 1:
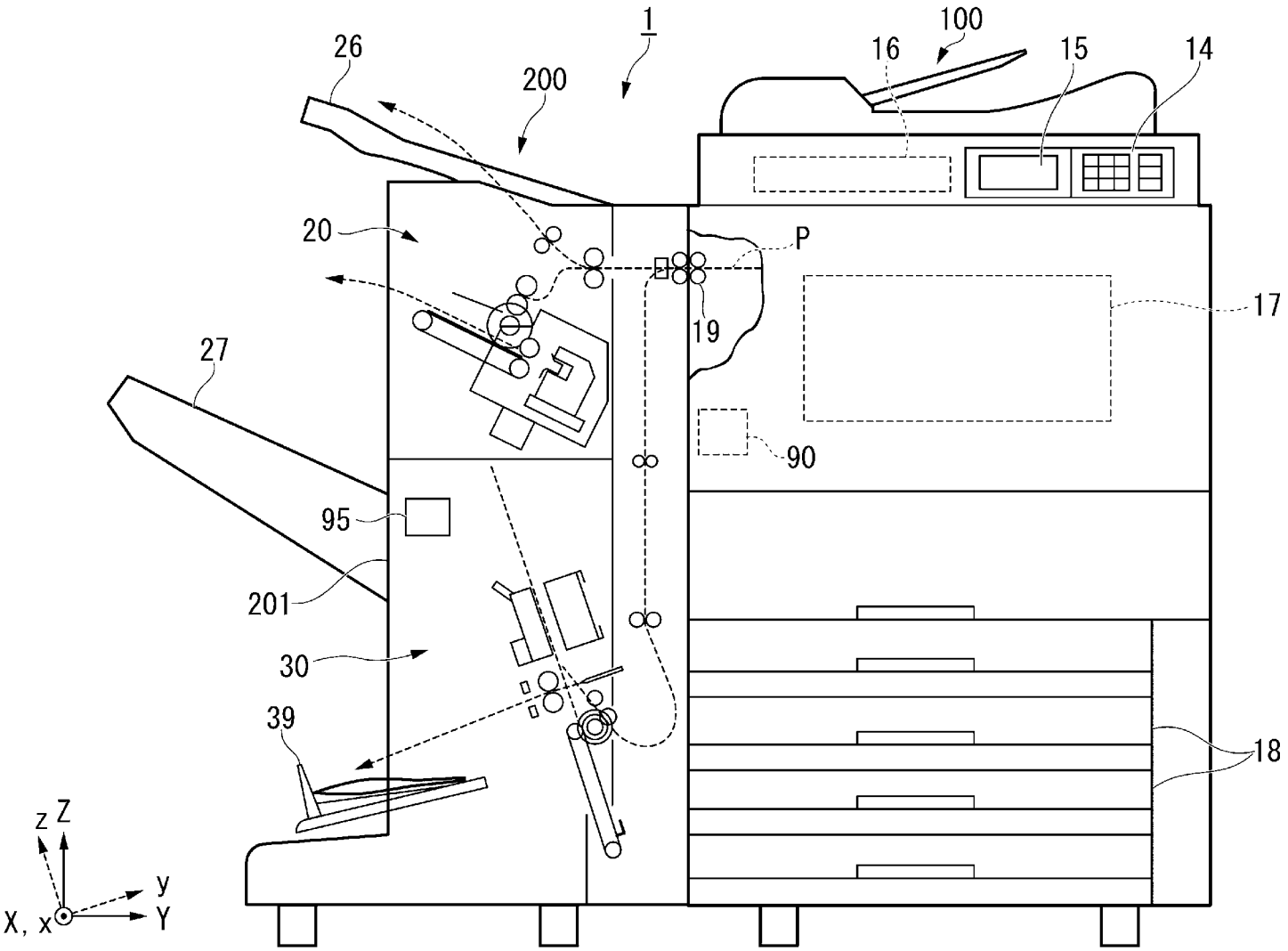
FIG. 1 is a schematic configuration diagram of an image forming apparatus.

FIG. 1 is a schematic configuration diagram of an image forming apparatus 1. For example, the image forming apparatus 1 is disposed in a workplace. The image forming apparatus 1 includes an image forming apparatus main body 100 and a sheet processing apparatus 200. The image forming apparatus main body 100 and the sheet processing apparatus 200 are disposed adjacent to each other.

A description will be given as to the image forming apparatus main body 100.

The image forming apparatus main body 100 forms an image on a sheet (recording medium) using a recording agent. The sheet is, for example, plain paper or label paper. A specific example of the recording agent is toner. The toner is either toner used as a decolorable recording agent or toner used as a non-decolorable recording agent.

For example, the image forming apparatus main body 100 is a multifunction printer (MFP). As shown in FIG. 1, the image forming apparatus main body 100 includes a display unit 15, an operation unit 14, an image reading unit 16, a printer unit 17, a sheet storage unit 18, and a paper discharge roller 19.

The display unit 15 is an image display device such as a liquid crystal display or an organic electro luminescence (EL) display. The display unit 15 displays various information related to the image forming apparatus main body 100 and the sheet processing apparatus 200.

The operation unit 14 includes a plurality of buttons. The operation unit 14 receives the operation of a user. The operation unit 14 outputs a signal corresponding to the operation performed by the user to a first control unit 90 of the image forming apparatus main body 100. The display unit 15 and the operation unit 14 May be configured as an integrated touch panel.

The image reading unit 16 reads image information to be read based on brightness and darkness of light. The image reading unit 16 outputs the read image information to the printer unit 17.

The sheet storage unit 18 stores sheets to be used for image formation. The sheet storage unit 18 supplies the stored sheets to the printer unit 17.

The printer unit 17 forms an image on a sheet based on the image information generated by the image reading unit 16 or image information received via a communication path. The printer unit 17 includes an image forming unit, a transfer unit, and a fixing device. The image forming unit forms an electrostatic latent image on a photosensitive drum based on the image information. The image forming unit forms a visible image by attaching toner to the electrostatic latent image. The transfer unit transfers the visible image onto the sheet. The fixing device heats and presses the toner to fix the visible image onto the sheet.

The paper discharge roller 19 is disposed near a paper discharge port of the image forming apparatus main body 100. The paper discharge roller 19 sends out the sheet having the image formed thereon to the sheet processing apparatus 200.

Figure 2:
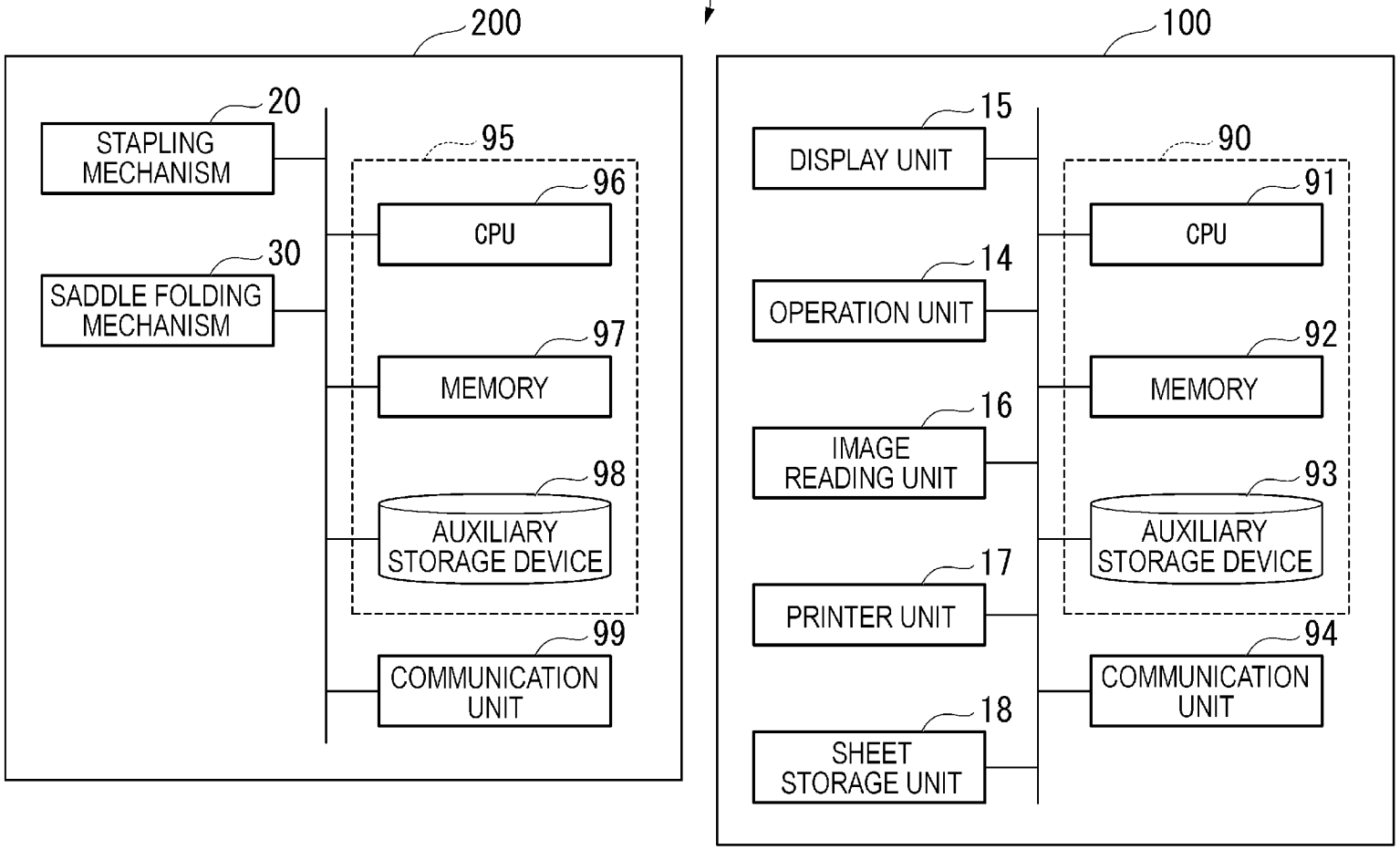
FIG. 2 is a block diagram showing a functional configuration example.

FIG. 2 is a block diagram showing a functional configuration example of the image forming apparatus 1. The image forming apparatus main body 100 includes a central processing unit (CPU) 91, a memory 92, an auxiliary storage device 93, and the like which are connected via a bus, and executes a program. The image forming apparatus main body 100 functions as an apparatus including the display unit 15, the operation unit 14, the image reading unit 16, the printer unit 17, the sheet storage unit 18, and a communication unit 94 by executing the program.

The CPU 91 functions as the first control unit 90 by executing a program stored in the memory 92 and the auxiliary storage device 93. The first control unit 90 controls the operation of each unit of the image forming apparatus main body 100 and the sheet processing apparatus 200.

The auxiliary storage device 93 includes a storage device such as a magnetic hard disk device or a semiconductor storage device. The auxiliary storage device 93 stores information.

The communication unit 94 includes a communication interface configured to connect an own device to an external device. The communication unit 94 communicates with the external device via the communication interface.

A description will be given as to the sheet processing apparatus 200.

Figure 3:
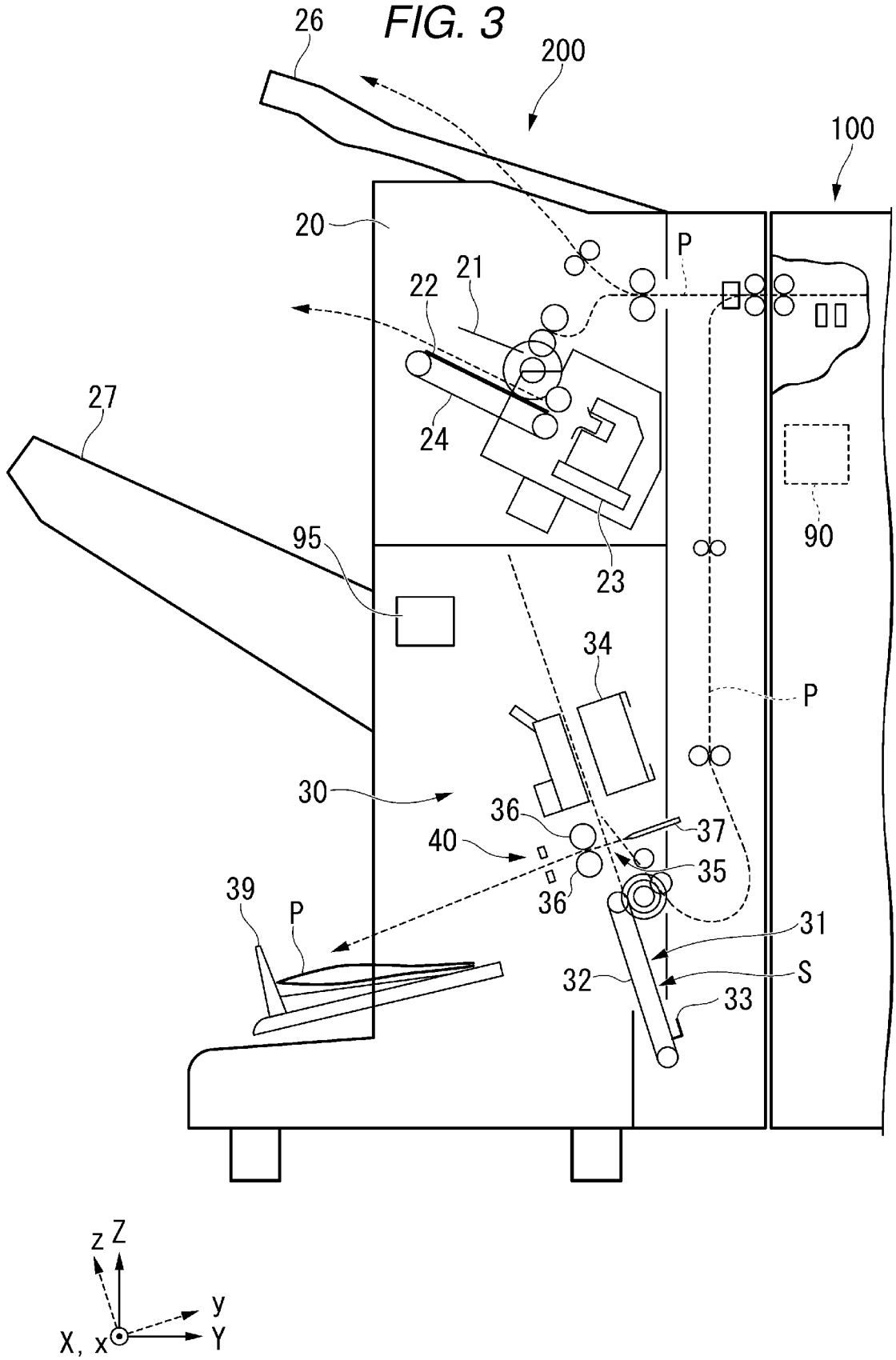
FIG. 3 is a front sectional view showing a schematic configuration of a sheet processing apparatus.

FIG. 3 is a front sectional view showing a schematic configuration of the sheet processing apparatus 200. The sheet processing apparatus 200 performs post-processing on a sheet P on which an image is formed. For example, the post-processing includes stapling or saddle folding. The sheet processing apparatus 200 includes a stapling mechanism 20 and a saddle folding mechanism 30.

The stapling mechanism 20 includes a standby tray 21, a processing tray 22 and a stapler 23. The stapler 23 staples a plurality of sheets P. The stapled sheets P are conveyed by a conveyance belt 24 and discharged to a movable tray 27.

The sheet processing apparatus 200 includes the movable tray 27 and an upper tray 26. The stapled sheets P are discharged to the movable tray 27. The sheet P not stapled is discharged to the upper tray 26.

A description will be given as to the saddle folding mechanism 30.

The saddle folding mechanism 30 includes a sheet position adjusting mechanism 31, a folding unit 35, a fold reinforcing unit 40, a lower tray 39, and a stapling unit 34.

The sheet position adjusting mechanism 31 includes a belt 32 and a lower end support member 33.

The belt 32 is an endless belt. The belt 32 is stretched around a pair of belt rollers and moves around the pair of belt rollers. The rotation axes of the pair of belt rollers are parallel to the X direction. A surface S of the belt 32 between the pair of belt rollers (simply referred to as the surface S) is an inclined surface, the normal direction of which is directed upwards from the horizontal. The sheet P is placed on the surface S of the belt 32.

As a local coordinate system of the present application, xyz directions of an orthogonal coordinate system are defined as follows. The x direction coincides with the X direction of the overall coordinate system. The y direction is the normal direction of the surface S of the belt 32. The −y direction is a direction from a blade 37 of the folding unit 35 toward a pair of folding rollers 36.

The z direction is a direction perpendicular to the x direction and the y direction. The z direction is parallel to the surface S of the belt 32. The +z direction is a direction from the belt 32 toward the folding unit 35.

The lower end support member 33 is formed in an L-shaped when viewed from the x direction. The lower end support member 33 is fixed to the surface S of the belt 32. The lower end support member 33 supports the lower end of the sheet P placed on the surface S of the belt 32. If the belt 32 moves around the pair of belt rollers, the lower end support member 33 moves the sheet P in the +z direction.

The folding unit 35 is in the +z direction of the belt 32. The folding unit 35 folds the sheet P to form a fold line thereon. The folding unit 35 includes the pair of folding rollers 36 and the blade 37.

The pair of folding rollers 36 are disposed in the z direction. The rotation axes of the pair of folding rollers 36 are parallel to the x direction.

The blade 37 has a flat shape and is parallel to the yz plane. The blade 37 has a tapered shape in the −y direction. The blade 37 is movable in the y direction.

The fold reinforcing unit 40 is located in the −y direction of the pair of folding rollers 36. The fold reinforcing unit 40 reinforces the fold line on the sheet P formed by the folding unit 35.

The lower tray 39 is located in the −y direction of the fold reinforcing unit 40 and disposed at a lower portion of the sheet processing apparatus 200. The saddle-folded sheet P is discharged to the lower tray 39.

The stapling unit 34 is in the +z direction of the folding unit 35. The stapling unit 34 staples a central portion of the sheet P in the z direction.

For example, the saddle folding mechanism 30 executes bookbinding processing for a plurality of sheets P. The sheet position adjusting mechanism 31 moves the sheet P in the +z direction to align the central portion of the sheet P in the z direction with the position of the stapling unit 34. The stapling unit 34 performs stapling on the plurality of sheets P. The sheet position adjusting mechanism 31 moves the sheet P in the −z direction so that the central portion of the sheet P in the z direction coincides with the position of the blade 37. The blade 37 moves in the −y direction to push the central portion of the sheet P between the pair of folding rollers 36. The plurality of sheets P are saddle-folded at the central portion in the z direction. A fold line is formed on an end edge in the −y direction of the sheet P in the saddle-folded state. The fold reinforcing unit 40 reinforces the fold line of the plurality of sheets P. As described above, the bookbinding processing for the plurality of sheets P is completed. The plurality of bound sheets P are discharged to the lower tray 39.

As shown in FIG. 2, the sheet processing apparatus 200 includes a central processing unit (CPU) 96, a memory 97, an auxiliary storage device 98, and the like which are connected via a bus, and executes a program. The sheet processing apparatus 200 functions as an apparatus including the stapling mechanism 20, the saddle folding mechanism 30, and a communication unit 99 by executing a program.

The CPU 96 functions as a second control unit (control unit) 95 by executing a program stored in the memory 97 and the auxiliary storage device 98. The second control unit 95 controls the operation of each unit of the sheet processing apparatus 200.

The auxiliary storage device 98 includes a storage device such as a magnetic hard disk device or a semiconductor storage device. The auxiliary storage device 98 stores information.

The communication unit 99 includes a communication interface configured to connect an own device to an external device. The communication unit 99 communicates with the external device via the communication interface.

A description will be given as to the fold reinforcing unit 40.

Figure 4:
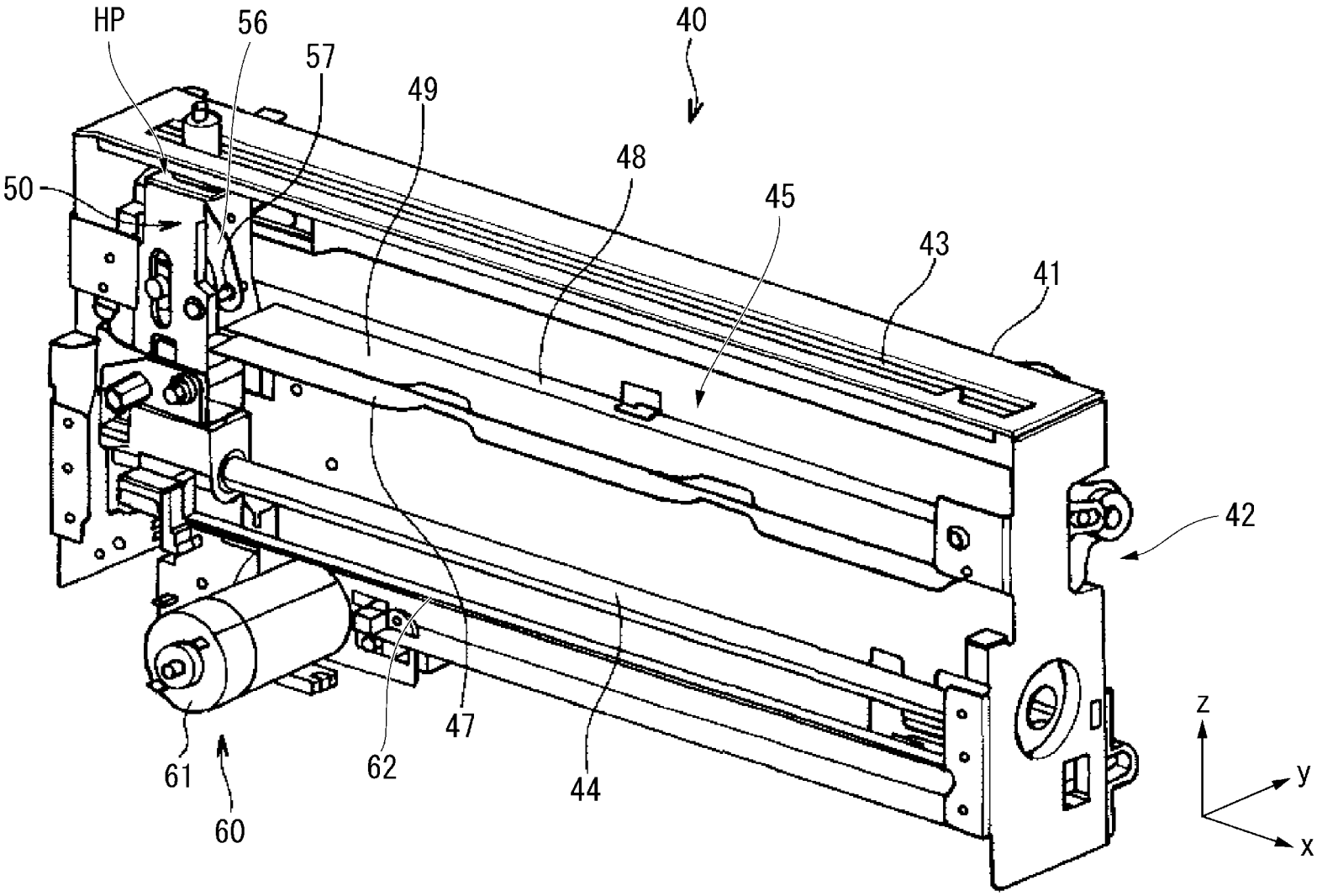
FIG. 4 is a perspective view of a fold reinforcing unit.
Figure 5:
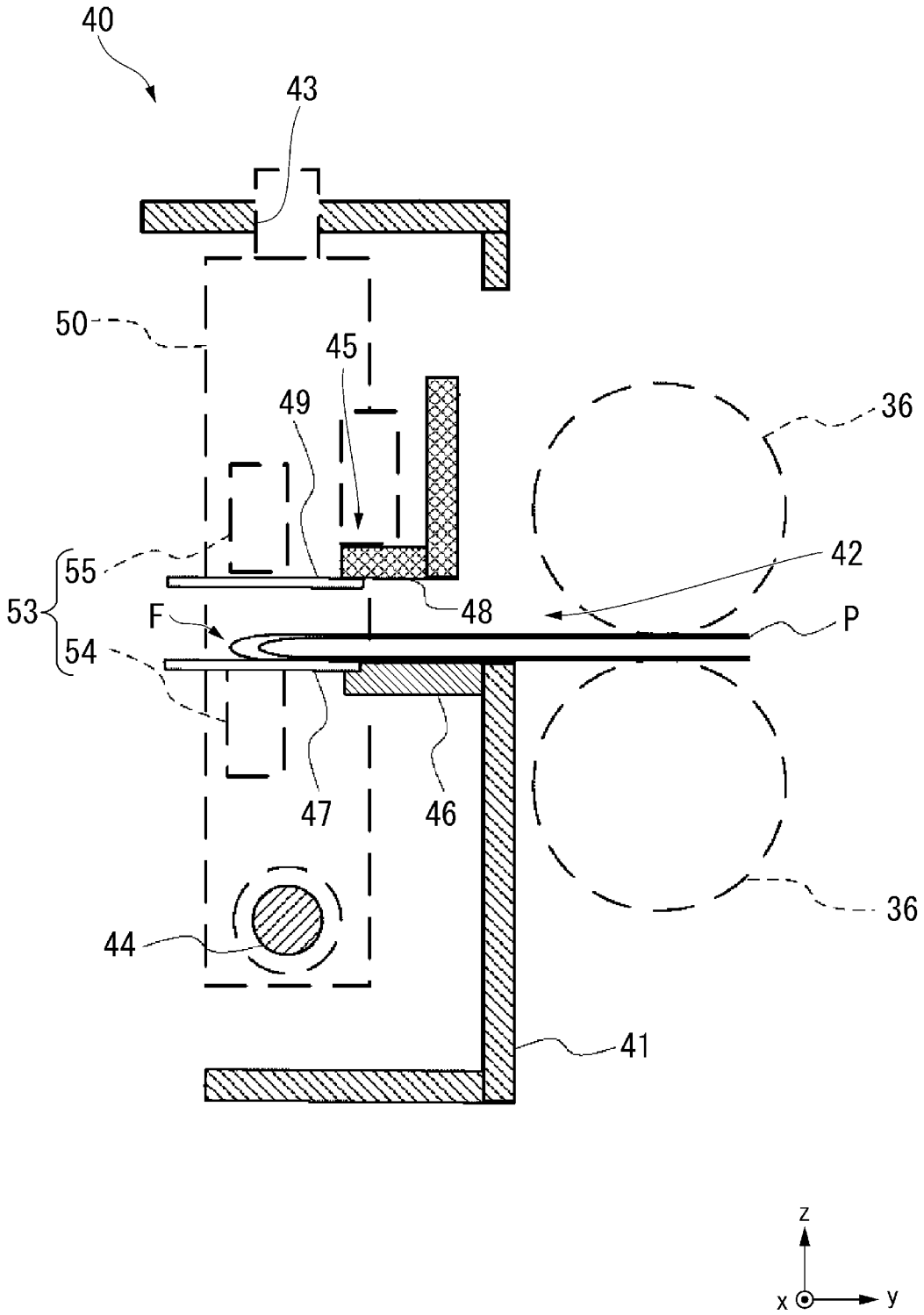
FIG. 5 is a perspective view of a roller unit.

FIG. 4 is a perspective view of the fold reinforcing unit 40. FIG. 5 is a front sectional view showing a schematic configuration of the fold reinforcing unit 40. The fold reinforcing unit 40 includes a frame 41, a support part 45, a roller unit 50, and a drive unit 60.

The frame 41 covers the +y direction, +z direction and ±x direction of the fold reinforcing unit 40. The frame 41 has a main plate in the +y direction. The main plate has a slit 42 formed to extend in the x direction. As shown in FIG. 5, the slit 42 permits entrance of the sheet P saddle-folded by the folding unit 35. As shown in FIG. 4, the frame 41 has a top plate in the +z direction. The top plate has a guide hole 43 formed to extend in the x direction. The frame 41 has a pair of side plates in the ±x directions. The pair of side plates supports opposite ends of a guide bar 44 formed to extend in the x direction. The guide hole 43 and the guide bar 44 guide the movement of the roller unit 50 in the x direction.

The support part 45, as shown in FIG. 5, includes a first support plate 46, a second support plate 48, a first film 47, and a second film 49. The first support plate 46, the second support plate 48, the first film 47, and the second film 49 are parallel to the xy plane.

The first support plate 46 is disposed at the end of the slit 42 in the −z direction and fixed to the frame 41. The first support plate 46 supports the sheet P from the −z direction.

The second support plate 48 is in the +z direction of the first support plate 46. The second support plate 48 is movable in the z direction. The second support plate 48 presses the sheet P from the +z direction.

The first film 47 and the second film 49 are made of a resin material or the like in a film shape and have flexibility.

An end of the first film 47 in the +y direction is fixed to an end of the first support plate 46 in the −y direction. The first film 47 supports a fold line F on the sheet P from the −z direction.

An end of the second film 49 in the +y direction is fixed to an end of the second support plate 48 in the −y direction. The second film 49 is movable in the z direction together with the second support plate 48. The second film 49 presses the fold line F on the sheet P from the +z direction.

Figure 6:
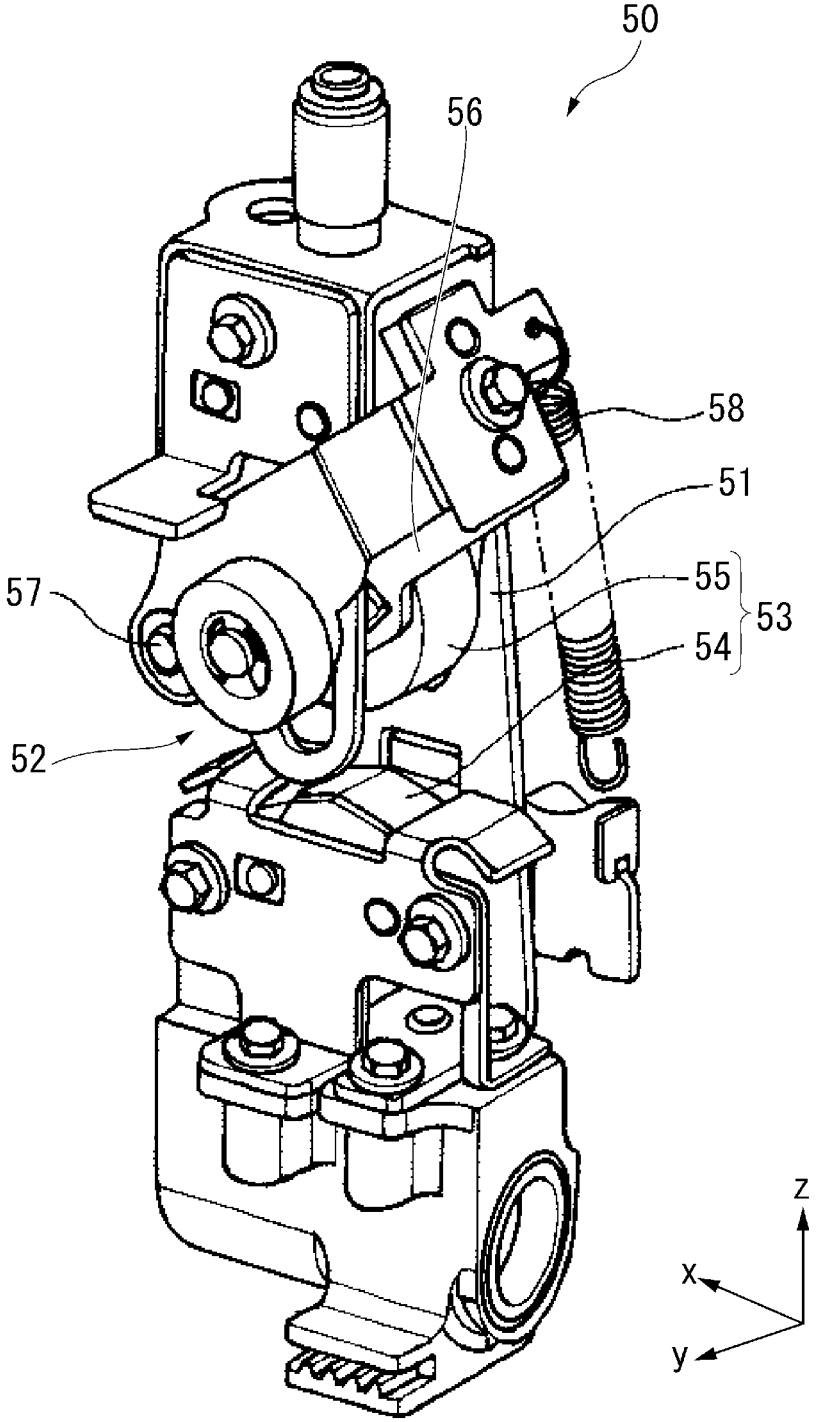
FIG. 6 is a front sectional view showing a schematic configuration of the fold reinforcing unit.

FIG. 6 is a perspective view of the roller unit 50. The roller unit 50 includes a roller frame 51 and a fold reinforcing roller 53.

The roller frame 51 is formed in an approximately C shape when viewed from the x direction, and includes an opening 52 in the +y direction. Interference between the sheet P entering the fold reinforcing unit 40 and the roller unit 50 is avoided by the opening 52.

The fold reinforcing roller 53 includes a first roller 54 and a second roller 55. Rotation axes of the first roller 54 and the second roller 55 are parallel to the y direction. Diameters of the first roller 54 and the second roller 55 are almost the same. Widths of the first roller 54 and the second roller 55 in the y direction are almost the same.

The first roller 54 is disposed inside the roller frame 51 in the −z direction of the opening 52. The first roller 54 is rotatably supported by the roller frame 51.

The second roller 55 is disposed inside the roller frame 51 in the +z direction of the opening 52. The second roller 55 is rotatably supported by an arm member 56. The arm member 56 is supported by the roller frame 51 in a state of being rotatable around a rotary shaft 57. A coil spring 58 is attached to the arm member 56.

The drive unit 60 is, as shown in FIG. 4, in the −z direction of the fold reinforcing unit 40. The drive unit 60 includes a drive belt 62 and a motor 61.

The drive belt 62 is stretched between a pair of pulleys separated in the x direction. Rotation axes of the pair of pulleys are parallel to the y direction. A part of the drive belt 62 is connected to the roller unit 50. The motor 61 circulates and moves the drive belt 62 via the pulley, thereby causing the roller unit 50 to move in the x direction.

During the operation of the saddle folding mechanism 30 shown in FIG. 3, the blade 37 pushes the central portion of the sheet P in the z direction between the pair of folding rollers 36. A fold line on the sheet P is formed at an end edge of the sheet P in the saddle-folded state in the −y direction. The pair of folding rollers 36 moves the sheet P in the −y direction. As shown in FIG. 5, if the fold line F on the sheet P reaches between the first film 47 and the second film 49 of the fold reinforcing unit 40, the movement of the sheet P is stopped.

The fold reinforcing unit 40 folds the fold line F on the sheet P as follows. The second control unit 95 controls the operation of each unit of the fold reinforcing unit 40.

The second support plate 48 and the second film 49 of the support part 45 move in the −z direction. The sheet P is interposed between the second support plate 48 and the second film 49, and the first support plate 46 and the first film 47. The fold line F on the sheet P is interposed between the first film 47 and the second film 49.

As shown in FIG. 4, an inner end of the frame 41 in the −x direction is a home position HP of the roller unit 50. If the saddle folding mechanism 30 is not operated, the roller unit 50 stands by at the home position HP. At the home position HP, the second roller 55 of the fold reinforcing roller 53 shown in FIG. 6 is separated from the first roller 54 in the +z direction.

If the sheet P enters the fold reinforcing unit 40, the roller unit 50 moves in the +x direction from the home position HP. As the roller unit 50 moves, the coil spring 58 pulls down the arm member 56 in the −z direction. The second roller 55 supported by the arm member 56 moves in the −z direction and approaches the first roller 54.

As shown in FIG. 5, the first roller 54 contacts a surface of the first film 47 in the −z direction. The second roller 55 contacts a surface of the second film 49 in the +z direction. The first roller 54 and the second roller 55 sandwich the fold line F on the sheet P via the first film 47 and the second film 49. The coil spring 58 shown in FIG. 6 biases the arm member 56 in the −z direction. The second roller 55 supported by the arm member 56 presses the fold line F on the sheet P via the second film 49. The fold reinforcing roller 53 moves in the x direction in which the fold line F extends. As a result, the fold line F on the sheet P is reinforced.

A description will be given as to a movement mode of the fold reinforcing roller 53 of the roller unit 50 in the x direction. The second control unit 95 controls the rotation of the motor 61 to control the movement of the fold reinforcing roller 53 in the x direction.

Figure 7:
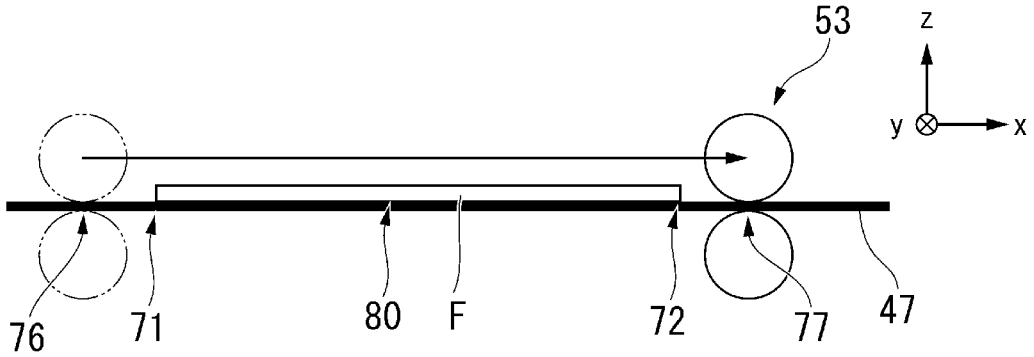
FIG. 7 is an explanatory diagram of a simple movement mode of a fold reinforcing roller.

FIG. 7 is an explanatory diagram of a simple movement mode of the fold reinforcing roller 53. In FIGS. 7 to 13, a description of the second film 49 is omitted. The second control unit 95 reciprocates the fold reinforcing roller 53 between a first end 71 of the fold line F in the −x direction and a second end 72 of the fold line F in the +x direction. The second control unit 95 moves the fold reinforcing roller 53 from a first position 76 near the first end 71 to a second position 77 near the second end 72 on an outward path.

The second control unit 95 can execute either a simple movement mode or a division movement mode of the fold reinforcing roller 53 on the outward path. The simple movement mode is a mode in which the fold reinforcing roller 53 is continuously moved only in the +x direction from the first position 76 to the second position 77. If the simple movement mode is executed, fold reinforcement is completed in a short time, so the productivity of the sheet processing apparatus 200 is improved.

FIGS. 8 to 12 are explanatory diagrams of the division movement mode of the fold reinforcing roller 53. The division movement mode is a mode including a reversal return operation of the fold reinforcing roller 53. The reversal return operation is an operation of reversing the movement direction of the fold reinforcing roller 53 in the −x direction at a middle portion of the fold line F and then returning the movement direction of the fold reinforcing roller in the +x direction. If the division movement mode is executed, the fold reinforcing roller 53 is repeatedly moved along each portion of the fold line F, and as such, the fold reinforcement is enhanced.

The second control unit 95 can execute the division movement mode including a plurality of times of reversal return operation. The fold reinforcement is enhanced by executing the reversal return operation a plurality of times. The division movement mode including two reversal return operations is described with reference to FIGS. 8 to 12.

Figure 8:
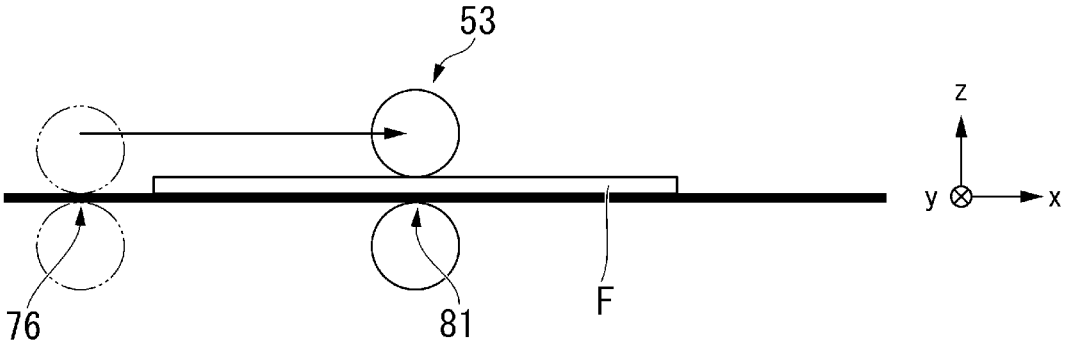
FIG. 8 is an explanatory diagram of a division movement mode.

As shown in FIG. 8, the second control unit 95 moves the fold reinforcing roller 53 from the first position 76 to a first intermediate point 81 in the +x direction.

Figure 9:
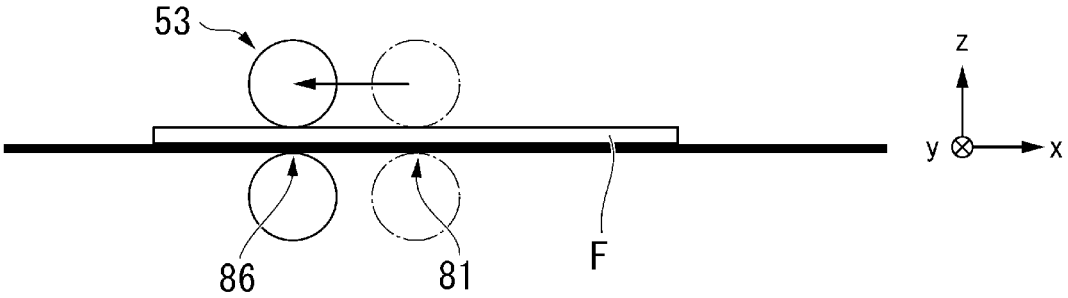
FIG. 9 is an explanatory diagram of the division movement mode.

In a first reversal return operation, as shown in FIG. 9, the second control unit 95 reverses the movement direction of the fold reinforcing roller 53 in the −x direction at the first intermediate point 81. The first intermediate point 81 is the middle portion of the fold line F. After that, as shown in FIG. 10, the second control unit 95 returns the movement direction of the fold reinforcing roller 53 in the +x direction at a first return point 86 between the first position 76 (or the first end 71) and the first intermediate point 81.

Figure 10:
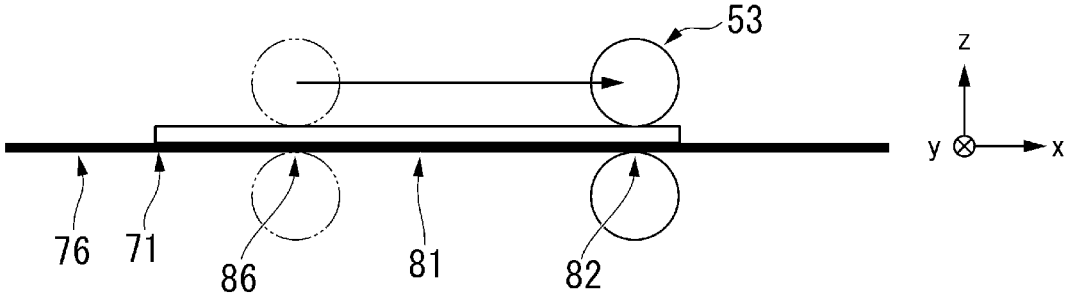
FIG. 10 is an explanatory diagram of the division movement mode.

As shown in FIG. 10, the second control unit 95 moves the fold reinforcing roller 53 from the first return point 86 to a second intermediate point 82 in the +x direction.

Figure 11:
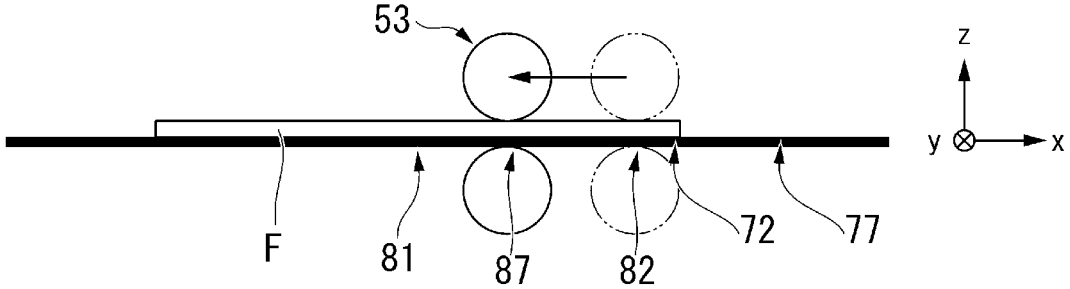
FIG. 11 is an explanatory diagram of the division movement mode.
Figure 12:
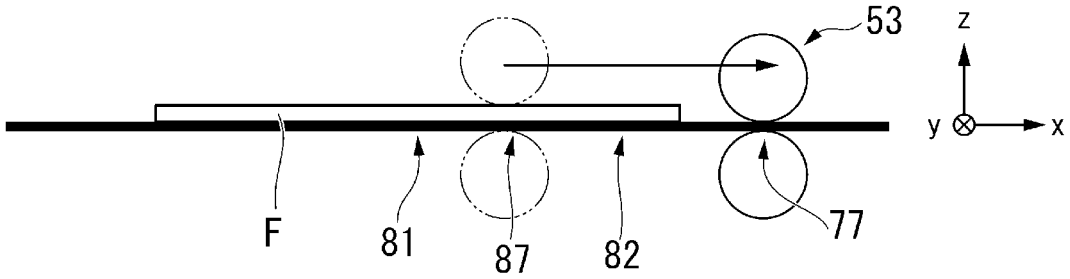
FIG. 12 is an explanatory diagram of the division movement mode.

In a second reversal return operation, as shown in FIG. 11, the second control unit 95 reverses the movement direction of the fold reinforcing roller 53 in the −x direction at the second intermediate point 82. The second intermediate point 82 is between the first intermediate point 81 and the second position 77 (or second end 72). Thereafter, as shown in FIG. 12, the second control unit 95 returns the movement direction of the fold reinforcing roller 53 in the +x direction at a second return point 87. The second return point 87 is between the first intermediate point 81 and the second intermediate point 82.

As shown in FIG. 12, the second control unit 95 moves the fold reinforcing roller 53 from the second return point 87 to the second position 77 in the +x direction. As described above, the division movement mode including the two reversal return operations is completed.

The second control unit 95 May execute the division movement mode including one or three or more reversal return operations on the outward path.

In the (n−1)th reversal return operation (n is a natural number of 2 or greater), the second control unit 95 reverses the movement direction of the fold reinforcing roller in the −x direction at the (n−1)th intermediate point which is the middle portion of the fold line. After that, the second control unit 95 returns the movement direction of the fold reinforcing roller 53 in the +x direction.

In the (n)th reversal return operation, the second control unit 95 reverses the movement direction of the fold reinforcing roller in the −x direction at the (n)th intermediate point between the (n−1)th intermediate point and the second position 77. After that, the second control unit 95 returns the movement direction of the fold reinforcing roller 53 in the +x direction between the (n−1)th intermediate point and the (n)th intermediate point.

Figure 13:
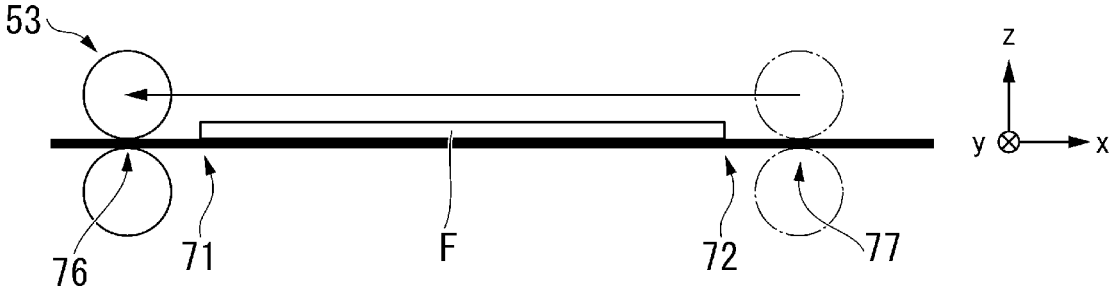
FIG. 13 is an explanatory diagram of a simple movement mode on a return path.

FIG. 13 is an explanatory diagram of the simple movement mode on a return path of the fold reinforcing roller. The second control unit 95 moves the fold reinforcing roller 53 from the second position 77 to the first position 76 on the return path. The second control unit 95 executes the simple movement mode on the return path. The simple movement mode on the return path is the same as the simple movement mode on the outward path. In the simple movement mode on the return path, the second control unit 95 continuously moves the fold reinforcing roller 53 from the second position 77 to the first position 76 only in the −x direction.

Productivity of the sheet processing apparatus 200 is greatly enhanced by executing the simple movement mode on both the outward path and the return path. By executing the division movement mode on the outward path and executing the simple movement mode on the return path, both the fold reinforcement on the sheet P and the productivity of the sheet processing apparatus 200 can be achieved.

The second control unit 95 May execute the division movement mode on the return path. The division movement mode on the return path is a mode including the reversal return operation of the fold reinforcing roller 53 in the same manner as the division movement mode on the outward path. The reversal return operation on the return path is an operation of reversing the movement direction of the fold reinforcing roller 53 in the +x direction at the middle portion of the fold line F and then returning the movement direction of the fold reinforcing roller in the −x direction. By executing the division movement mode on both the outward path and the return path, the fold reinforcement on the sheet P can be greatly enhanced.

A description will be given as to how to select the simple movement mode or the division movement mode. The second control unit 95 selects either the simple movement mode or the division movement mode and executes the selected mode based on information on the sheet P or selection by a user.

The first control unit 90 of the image forming apparatus main body 100 shown in FIG. 1 stores information on the sheet P on which an image is to be formed. For example, the information on the sheet P includes the basis weight of the sheet P, the number of sheets P, the size of the sheet P, and the like. The basis weight of the sheet P is the weight per unit area of the sheet P and is proportional to density and thickness of the sheet P. The number of sheets P is the number of sheets P to be saddle-folded at one time. The size of the sheet P may be a length of the sheet P in the x direction. The length of the sheet P in the x direction corresponds to a length of the fold line F.

The information on the sheet P is acquired by a sensor installed in the image forming apparatus main body 100. The information on the sheet P may be input to the operation unit 14 by a user. The first control unit 90 acquires the information on the sheet P and transmits the same to the second control unit 95. The second control unit 95 receives the information on the sheet P from the first control unit 90.

The second control unit 95 executes either the simple movement mode or the division movement mode based on the basis weight of the sheet P. A threshold value related to the basis weight of the sheet P is recorded in advance in the second control unit 95. The second control unit 95 executes the simple movement mode if the basis weight of the sheet P is less than a first threshold value. If the basis weight of the sheet P is small, the fold line F is easily formed on the sheet P. The sufficient fold line F is formed on the sheet P only by executing the simple movement mode. By executing the simple movement mode, the productivity of the sheet processing apparatus 200 is increased. The second control unit 95 executes the division movement mode if the basis weight of the sheet P is the first threshold value or greater. If the basis weight of the sheet P is large, it is difficult to form the fold line F on the sheet P. The fold reinforcement on the sheet P is enhanced by executing the division movement mode, and as such, the sufficient fold line F is formed on the sheet P.

A plurality of the threshold values related to the basis weight of the sheet P may be recorded in advance in the second control unit 95. If the basis weight of the sheet P is the first threshold value or greater, the second control unit 95 executes the division movement mode including one reversal return operation. If the basis weight of the sheet P is a (n)th threshold value or greater (n is a natural number of 2 or greater), wherein the (n)th threshold value is greater than the first threshold value, the second control unit 95 executes the division movement mode including the (n) reversal return operations. As the basis weight of the sheet P increases, the division movement mode including a large number of reversal return operations is executed. As the basis weight of the sheet P increases, the fold reinforcement on the sheet P is enhanced, thereby forming the sufficient fold line F on the sheet P.

The second control unit 95 executes either the simple movement mode or the division movement mode based on the number of sheets P. A threshold value related to the number of sheets P is recorded in advance in the second control unit 95. The second control unit 95 executes the simple movement mode if the number of sheets P is less than a first threshold value. If the number of sheets P is small, the fold line F is easily formed on the sheet P. The sufficient fold line F is formed on the sheet P only by executing the simple movement mode. By executing the simple movement mode, the productivity of the sheet processing apparatus 200 is increased. The second control unit 95 executes the division movement mode if the number of sheets P is the first threshold value or greater. If the number of sheets P is large, it is difficult to form the fold line F on the sheet P. The fold reinforcement on the sheet P is enhanced by executing the division movement mode, and as such, the sufficient fold line F is formed on the sheet P.

A plurality of threshold values related to the number of sheets P may be recorded in advance in the second control unit 95. If the number of sheets P is the first threshold value or greater, the second control unit 95 performs the division movement mode including one reversal return operation. If the number of sheets P is a (n)th threshold value or greater (n is a natural number of 2 or greater), wherein the (n)th threshold value is greater than the first threshold value, the second control unit 95 executes the division movement mode including the (n) reversal return operations. As the number of sheets P increases, the division movement mode including a large number of reversal return operations is executed. As the number of sheets P increases, the fold reinforcement on the sheet P is enhanced, thereby forming the sufficient fold line F on the sheet P.

The second control unit 95 executes either the simple movement mode or the division movement mode based on the size of the sheet P. A threshold value related to the size of the sheet P is recorded in advance in the second control unit 95. The second control unit 95 executes the simple movement mode if the size of the sheet P is less than a first threshold value. If the size of the sheet P is small, the fold line F is easily formed on the sheet P. The sufficient fold line F is formed on the sheet P only by executing the simple movement mode. By executing the simple movement mode, the productivity of the sheet processing apparatus 200 is increased. The second control unit 95 executes the division movement mode if the size of the sheet P is the first threshold value or greater. If the size of the sheet P is large, it is difficult to form the fold line F on the sheet P. The fold reinforcement on the sheet P is enhanced by executing the division movement mode, and as such, the sufficient fold line F is formed on the sheet P.

A plurality of threshold values related to the size of the sheet P may be recorded in advance in the second control unit 95. If the size of the sheet P is the first threshold value or greater, the second control unit 95 executes the division movement mode including one reversal return operation. If the size of the sheet P is a (n)th threshold value or greater (n is a natural number of 2 or greater), wherein the (n)th threshold value is greater than the first threshold value, the second control unit 95 executes the division movement mode including the (n) reversal return operations. As the size of the sheet P is larger, the division movement mode including a large number of reversal return operations is executed. As the size of the sheet P is larger, the fold reinforcement on the sheet P is enhanced, thereby forming the sufficient fold line F on the sheet P.

The second control unit 95 executes either the simple movement mode or the division movement mode based on the selection by the user. The second control unit 95 receives a mode selection signal generated by a user's selection operation of the simple movement mode or the division movement mode. The second control unit 95 executes either the simple movement mode or the division movement mode based on the mode selection signal.

A selection screen for the simple movement mode and the division movement mode is displayed on the display unit 15 shown in FIG. 1. The user executes the selection operation of the simple movement mode and the division movement mode in the operation unit 14. The user selects the simple movement mode when prioritizing the productivity of the sheet processing apparatus 200. The user selects the division movement mode when prioritizing the enhancement of the fold reinforcement on the sheet P. The first control unit 90 generates the mode selection signal according to the mode selection operation of the user. The second control unit 95 receives the mode selection signal from the first control unit 90. The second control unit 95 executes either the simple movement mode or the division movement mode based on the received mode selection signal.

The second control unit 95 determines the number of reversal return operations when executing the division movement mode based on the selection by the user. The second control unit 95 determines the number of reversal return operations based on the information on the basis weight of the sheet P, the number of sheets P, and the size thereof. As a result, the degree of enhancement of the fold reinforcement on the sheet P is appropriately set.

The second control unit 95 reduces a movement speed of the fold reinforcing roller 53 at the first end 71 and the second end 72 of the fold line F on the sheet P.

For example, as shown in FIG. 7, the second control unit 95 moves the fold reinforcing roller 53 in the +x direction. The fold reinforcing roller 53 enters the fold line F at the first end 71 and exits from the fold line F at the second end 72. The movement speed of the fold reinforcing roller in the +x direction at the first end 71 is V1. The movement speed of the fold reinforcing roller in the +x direction at the second end 72 is V2. The maximum movement speed of the fold reinforcing roller 53 in the +x direction between the first end 71 and the second end 72 is Vmax. The second control unit 95 sets each of V1 and V2 to be smaller than Vmax.

It is difficult to form the fold line F on the first end 71 and the second end 72 of the fold line F on the sheet P. By lowering V1 and V2, the stay time of the fold reinforcing roller 53 at the first end 71 and the second end 72 is increased. In this manner, the fold reinforcement at the first end 71 and the second end 72 is enhanced, thereby forming the sufficient fold line F on the whole sheet P.

As described above in detail, the sheet processing apparatus 200 of the embodiment includes the folding unit 35, the fold reinforcing unit 40, and the second control unit 95. The folding unit 35 folds the sheet P to form the fold line F thereon. The fold reinforcing unit 40 includes the fold reinforcing roller 53. The fold reinforcing roller 53 sandwiches the fold line F on the sheet P formed by the folding unit 35 and moves the same in the x direction in which the fold line F extends. The second control unit 95 moves the fold reinforcing roller 53 from the first position 76 near the first end 71 of the fold line F in the −x direction to the second position 77 near the second end 72 of the fold line F in the +x direction opposite to the −x direction. At that time, the second control unit 95 can execute the division movement mode including the reversal return operation. The reversal return operation is an operation of reversing the movement direction of the fold reinforcing roller 53 in the −x direction at the middle portion of the fold line F and then returning the movement direction of the fold reinforcing roller 53 in the +x direction.

In the division movement mode, the fold reinforcing roller 53 is repeatedly moved along each portion of the fold line F. As a result, the fold reinforcement on the sheet P can be enhanced.

Figure 14:
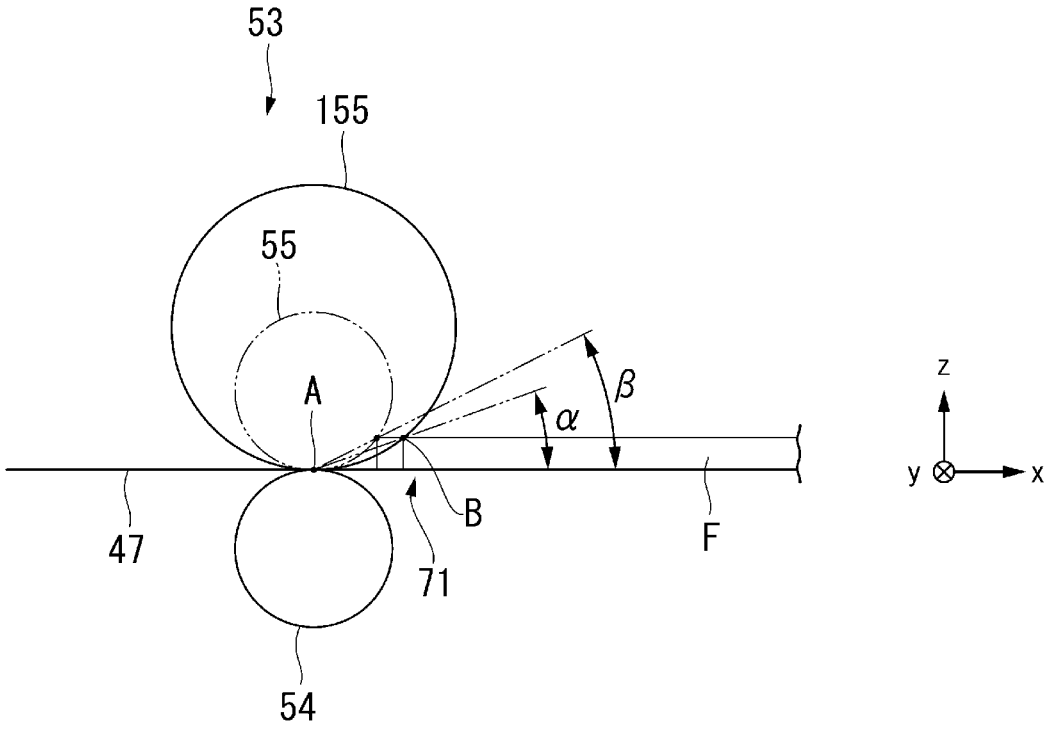
FIG. 14 is an explanatory diagram of a fold reinforcing roller according to a first modification.

FIG. 14 is an explanatory diagram of the fold reinforcing roller 53 of a first modification of the embodiment. In FIG. 14, the description of the second film 49 is omitted. In the fold reinforcing roller 53 of the embodiment described above, the diameter of the second roller 55 is almost the same as the diameter of the first roller 54. On the other hand, in the fold reinforcing roller 53 of the first modification, a diameter of a second roller 155 is larger than the diameter of the first roller 54. A portion of the first modification similar to the above-described embodiment may not be described.

The second control unit 95 drives the motor 61 to move the first roller 54 and the second roller 155 in the +x direction. The second roller 155 moves in the +z direction while moving in the +x direction, and rides on the first end 71 of the fold line F. Points A and B are defined at a time point if the second roller 155 rides on the first end 71. The point A is an end point of an outer periphery of the second roller 155 in the −z direction. The point B is a contact point between the outer periphery of the second roller 155 and the first end 71. An angle between a straight line passing through the points A and B and the +x direction is a riding angle α of the second roller 155 of the first modification. Similarly, a riding angle β of the second roller 55 of the embodiment is defined.

The diameter of the second roller 155 of the first modification is larger than the diameter of the second roller 55 of the embodiment. Therefore, the riding angle α of the second roller 155 of the first modification is smaller than the riding angle β of the second roller 55 of the embodiment. Since the riding angle α of the second roller 155 of the first modification is small, the second roller 155 rides on the first end 71 only by applying small force in the +x direction. An output of the motor 61 required for the riding of the second roller 155 is reduced, thereby making it possible to reduce current applied to the motor 61. The second roller 155 can ride on the thick fold line F by maintaining the current applied to the motor 61.

Figure 15:
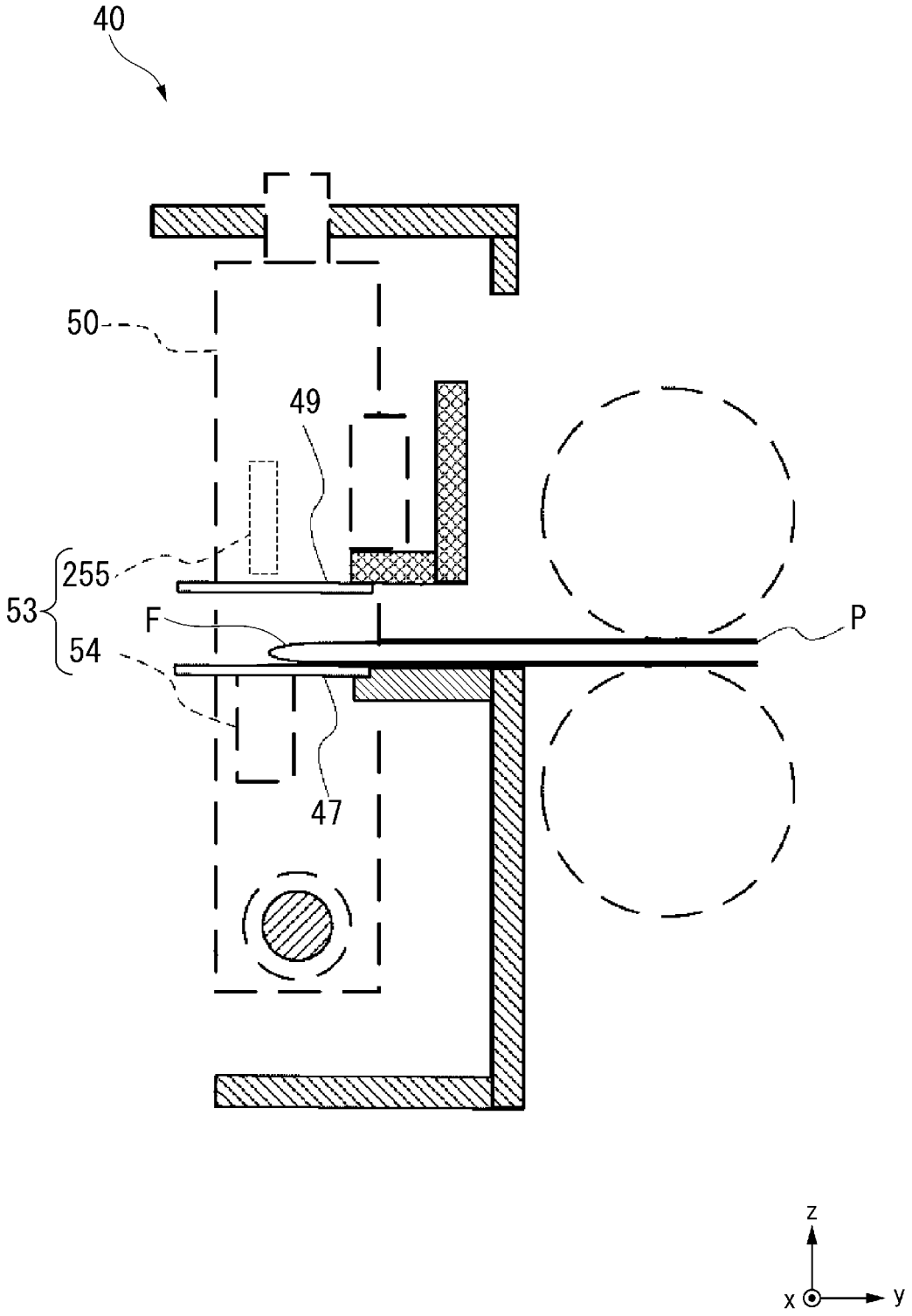
FIG. 15 is a front sectional view showing a schematic configuration of a fold reinforcing unit of a second modification.

FIG. 15 is a front sectional view showing a schematic configuration of the fold reinforcing unit 40 of a second modification of the embodiment. In the fold reinforcing roller 53 of the embodiment described above, the width of the second roller 55 is almost the same as the width of the first roller 54. On the other hand, in the fold reinforcing roller 53 of the second modification, a width of a second roller 255 is smaller than the width of the first roller 54. A portion of the second modification similar to the above-described embodiment may not be described.

The first roller 54 and the second roller 255 of the fold reinforcing roller 53 sandwich the fold line F on the sheet P. The coil spring 58 shown in FIG. 6 biases the second roller 255 in the −z direction via the arm member 56. The second roller 255 presses the fold line F on the sheet P via the second film 49. As shown in FIG. 15, the width of the second roller 255 in the y direction is smaller than the width of the first roller 54 in the y direction. The pressure acting on the fold line F from the second roller 255 increases. Accordingly, the fold reinforcement on the sheet P is enhanced, and as such, the sufficient fold line F is formed on the sheet P.

According to at least one embodiment described above, the second control unit 95 capable of executing the division movement mode is provided. As a result, the fold reinforcement on the sheet P can be enhanced.

While certain embodiments have been described, these embodiments have been presented by way of example only, and are not intended to limit the scope of the inventions. Indeed, the novel embodiments described herein may be embodied in a variety of other forms: furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet processing apparatus, comprising:

a saddle folding mechanism configured to fold a sheet and form a fold line on the sheet;

fold reinforcing rollers including a first roller which is disposed on a lower side and a second roller which is disposed on an upper side, the fold reinforcing rollers configured to sandwich the fold line of the sheet by the first roller and the second roller and move in a fold-line direction in which the fold line extends; and a controller configured to set, when moving the fold reinforcing rollers from a first position close to a first end of the fold line on a first side in the fold-line direction to a second position close to a second end of the fold line on a second side opposite to the first side, a division movement mode including at least once a reversal return operation of reversing a movement direction of the fold reinforcing rollers, wherein a width of the second roller is smaller than a width of the first roller.

2. The sheet processing apparatus according to claim 1, wherein the second roller of the fold reinforcing rollers is separated from the first roller in the vertical direction at a home position in a non-operating state.

3. The sheet processing apparatus according to claim 1, further comprising:

a coil spring configured to pull down the second roller rotatably supported by an arm member moving in the vertical direction and approaching the first roller.

4. The sheet processing apparatus according to claim 1, wherein a diameter of the second roller is larger than a diameter of the first roller.

5. The sheet processing apparatus according to claim 1, wherein the controller is further configured to:

set, when moving the fold reinforcing rollers from the first position to the second position, a simple movement mode in which the fold reinforcing roller is continuously moved only to the second side;

receive an information of the sheet; and execute either the simple movement mode or the division movement mode based on the information of the sheet.

6. The sheet processing apparatus according to claim 5, wherein the sheet information includes at least one of weight of the sheet, a number of sheets, and a size of the sheet.

7. The sheet processing apparatus according to claim 5, wherein the controller determines the number of reversal return operations based on the information of sheet.

8. The sheet processing apparatus according to claim 1, wherein the controller executes, when moving the fold reinforcing rollers from the first position to the second position, a simple movement mode in which the fold reinforcing rollers are continuously moved only to the second side, and the controller executes either the simple movement mode or the division movement mode based on the number of sheets.

9. The sheet processing apparatus according to claim 1, wherein the controller executes, when moving the fold reinforcing rollers from the first position to the second position, a simple movement mode in which the fold reinforcing rollers are continuously moved only to the second side, and the controller executes either the simple movement mode or the division movement mode based on a size of the sheet.

10. A sheet processing method, comprising:

folding a sheet to form a fold line on the sheet;

sandwiching the fold line of the sheet using fold reinforcing rollers including a first roller which is disposed on a lower side and a second roller which is disposed on an upper side and moving the fold reinforcing rollers in a fold-line direction in which the fold line extends; and setting, when moving the fold reinforcing rollers from a first position close to a first end of the fold line on a first side in the fold-line direction to a second position close to a second end of the fold line on a second side opposite to the first side, a division movement mode including at least once a reversal return operation of reversing a movement direction of the fold reinforcing rollers, wherein a width of the second roller is smaller than a width of the first roller.

11. The sheet processing method according to claim 10, further comprising:

separating the second roller of the fold reinforcing rollers from the first roller in the vertical direction at a home position in a non-operating state.

12. The sheet processing method according to claim 10, further comprising:

pulling down with a coil spring the second roller rotatably supported by an arm member moving in the vertical direction and approaching the first roller.

13. The sheet processing method according to claim 10, wherein a diameter of the second roller is larger than a diameter of the first roller.

14. The sheet processing method according to claim 10, further comprising:

setting, when moving the fold reinforcing rollers from the first position to the second position, a simple movement mode in which the fold reinforcing roller is continuously moved only to the second side;

receiving an information of the sheet; and executing either the simple movement mode or the division movement mode based on the information of the sheet.

15. The sheet processing method according to claim 14, wherein the sheet information includes at least one of weight of the sheet, a number of sheets, and a size of the sheet.

16. The sheet processing method according to claim 14, further comprising:

determining the number of reversal return operations based on the information of sheet.

17. The sheet processing method according to claim 10, further comprising:

executing, when moving the fold reinforcing rollers from the first position to the second position, a simple movement mode in which the fold reinforcing rollers are continuously moved only to the second side, and executing either the simple movement mode or the division movement mode based on the number of sheets.

18. The sheet processing method according to claim 10, further comprising:

executing, when moving the fold reinforcing rollers from the first position to the second position, a simple movement mode in which the fold reinforcing rollers are continuously moved only to the second side, and executing either the simple movement mode or the division movement mode based on a size of the sheet.

* * * * *